US006450538B2

(12) United States Patent
Errard

(10) Patent No.: US 6,450,538 B2
(45) Date of Patent: Sep. 17, 2002

(54) TWO-PART TOKEN AND METHOD OF USING SAME FOR BUSINESS PURPOSES

(76) Inventor: Emmanuel Errard, 5 bis, avenue Pierre Grenier, F-92100 Boulogne (FR)

( * ) Notice: Subject to any disclaimer, the term of this patent is extended or adjusted under 35 U.S.C. 154(b) by 0 days.

(21) Appl. No.: 09/794,907

(22) Filed: Feb. 28, 2001

Related U.S. Application Data

(63) Continuation-in-part of application No. 09/530,071, filed as application No. PCT/FR99/01934 on Aug. 4, 1999.

(30) Foreign Application Priority Data

Aug. 10, 1998 (FR) ..... 98/10238

(51) Int. Cl.[7] ..... B42D 15/00

(52) U.S. Cl. ..... 283/72; 283/74; 283/65; 235/78 R

(58) Field of Search ..... 283/65, 117, 72, 283/73, 74, 98, 113; 235/78 R, 78 F, 83

(56) References Cited

U.S. PATENT DOCUMENTS 857,662 A 6/1907 Odor
1,074,433 A * 9/1913 Hornbostel ..... 235/78 R
5,173,566 A * 12/1992 Hiraoka ..... 235/78 R
5,228,723 A 7/1993 Hertig
5,273,320 A 12/1993 deMaCarty
5,286,953 A * 2/1994 Marvonek et al. ..... 235/78 R

FOREIGN PATENT DOCUMENTS

| | | |
|---|---|---|
| DE | 9400167 | 3/1994 |
| EP | 0694872 A1 | 1/1996 |
| WO | WO 9526657 | 10/1995 |

* cited by examiner

*Primary Examiner*—William Fridie, Jr.
(74) *Attorney, Agent, or Firm*—Young & Thompson

(57) ABSTRACT

A two-part token for business purposes includes an inner part and an outer part. Both parts are assembled by similarity of form; namely, the token has corresponding indents and projections for indexing the inner part on the outer part. A code is stamped on each part such that, when the parts are assembled, both codes are mutually extending from each other, preferably, adjacent to each other to allow a barcode reader to readily scan both codes.

15 Claims, 1 Drawing Sheet

TWO-PART TOKEN AND METHOD OF USING SAME FOR BUSINESS PURPOSES

This application is a continuation-in-part of application Ser. No. 09/530,071, filed Apr. 10, 2000, which is a 371 of PCT/FR99/01934, filed Aug. 4, 1999.

BACKGROUND OF THE INVENTION

This invention relates to a two-part token and to a method of using same for business purposes.

Tokens can be used in two different ways. First, tokens can be used as a substitute for money, for example for vending machines. Vending machines such as those distributing low-price products like refreshments or hot drinks, are often operated with tokens in order to avoid that the clients have to have available an appropriate number and type of coins. Further, the use of tokens reduces the risk of vandalism, since there is no money to be robbed from that type of machine.

Second, tokens can be used as an exchange means, either for buying something or for getting it temporarily. Thus, when the owner or the holder of a token wants to buy a product or a service or borrow an object such as a book in a library, he hands the token over to the sales personnel and receives a commodity or is provided with a service or a right of entry. By accumulating the tokens, the seller of the commodity or the like is able to tell how many items have been sold and when to restock the items, or to find out how many people have attended an event or received a service. Different types of token may be attributed to different items or services in order to facilitate this task.

The seller may wish to reward the buyers or users who have used a large number of tokens. He further may wish to reward buyers not only for having bought certain items but also for having bought them in his shop or supermarket. Still further, the seller may wish to perform a lottery from time to time.

SUMMARY OF THE INVENTION

The invention allows for this by providing a token that is cheap to manufacture and very easy to handle. This token is in two parts, an inner one and an outer one, both parts being assembled by similarity of form. The token is provided with means for indexing the inner part on the outer part, and a code is stamped on each part such that, when the parts are assembled, both codes are mutually extending from each other.

With respect to the present invention, similarity of form means that the shape of the outer edge of the inner part corresponds to the shape of the inner edge of the outer part to such an extent that, when both parts are assembled, there is no, or at least not much, space left between the inner part and the outer part. Thus, the inner part will be held in the outer part by the forces of friction, but can be detached from it by simple finger pressure.

In a more general manner, similarity of form means that both parts of the two-part token of the invention are formed such that they look, at least along a sufficient length respectively of the outer edge of the inner part and of the inner edge of the outer part, as if the inner part would have been moulded to the outer part.

In an even more general manner, but still within the scope of the present invention, the features "similarity of form" and "holding by the forces of friction" are also applicable when the outer part does not surround the inner part entirely, but to a large extent, only.

Both parts of the token of the present invention are made of a sufficiently elastic materiel allowing the inner part to be inserted into the outer part and to be held therein in spite of its weight. It is important that the outer part holds the inner part securely, since the token is supposed to be introduced into a reader and to be taken out therefrom without any risk of disassembling.

The indexing means consist preferably of an indent provided in one of the two parts and a projection provided in the other part and fitting into the indent. According to the preferred embodiment described below, the indent is provided in the inner part, and the projection is provided in the outer part of the token. However, providing the outer part with an indent and the inner part with a projection obtains the same result: to make sure that the inner part will be inserted into the outer part in a predetermined position, in order to allow a machine to read the thus assembled codes of the two parts as a unique code or, at least, to read them at the same time, and preferably by means of a single reading device.

According to a variant of the afore-mentioned configuration, the two-part token of the invention can be provided with two or more indents and an according number of projections.

According to a further variant, the two parts of the token can be provided respectively with a single indent and a single projection, wherein the indent and the projection have a complex shape as described together with the preferred embodiment.

The two-part conception of the token according to the present invention is based on the idea to attribute one code to a product, a service, or the like, and another code to a person buying or using said product, service, or the like, and to be able, then, to reward this person according to predetermined criteria as will be explained in further detail elsewhere in this specification.

In order to be able to perform such rewarding, a code is stamped on each part of the token. When the two parts are assembled, the two codes are extensions of each other in being, preferably, adjacent to each other.

A preferred method of manufacturing tokens according to the invention is to make the outer part as a ring and the inner part in the form of a disk. But it is also within the scope of the present invention to make one part rectangular and the other part circular or both parts rectangular or square or in any other form, provided that the inner part be sufficiently strongly held by the outer part. Similarly, it is not absolutely essential that the outer part surrounds the inner part completely, as long as the retaining edge is sufficiently long and strong.

The tokens are preferably made of cardboard or of a flexible plastic material. They also can be made of different material, the outer part being made, for example, of cardboard and the inner one of plastic material.

When a token is presented in a shop, a code reader can read the codes very easily because they follow each other. The first code, for example on the inner part, is the customer identity code whereas the second code, for example on the outer part, identifies the commodity bought. Thus the computer at the place of sale receives a code including the customer's identity and can immediately consult its memory to see whether the same customer has already bought other commodities and whether he or she merits a bonus.

According to the invention, the customer's identity can be either a symbolic one or the real one. A symbolic identity will be sufficient, when a customer shall get a reward for each third, fourth, . . . product of the same type, or of the same family of products, that he buys. The real identity will be necessary, when the reward shall be attributed to the customer's account or when the customer is rewarded only, if he has bought all said products at the same place of sale, e.g. a shop or a supermarket.

In order to provide for the latter condition, the customer's identity code may include the seller's code. According to a variant of that embodiment, that part of the token, which is provided with the customer's identity code, has a moulded-in or printed-thereupon sign identifying the seller.

When the two-part token according to the present invention is used by a customer, the assembled token is introduced into a reading device of a cash register, which reads the entire code of the token and recognizes and registers both the customer identity part and the product or service identity part of the code. Then the cash register, compares these data with already registered data in order to open an award account, if the customer is using such a token for the first time. If the customer has already used such a token, the newly registered data will increment his award account. If predetermined conditions are fulfilled, the customer will get an award. That award can be an immediate price reduction that will be automatically introduced into the bill being established by the cash register. As an alternative solution, that award can be a bonus transferred to and accumulated in a specific account.

Further, the two-part token can be used as a means for a lottery. This lottery can be independent from, or on the contrary, be linked to, whether the customer has already an award account, or not. Thus, the manufacturer of a product may join to certain articles of that product, tokens having a specific product identity code: the winning code. When a customer uses the product identity part of such a token, he will get a prize. According to a variant thereof, the seller of the product may give an additional prize, if a predetermined condition is fulfilled.

Once the token has been read, it is taken out of the reading device and the two parts are separated from one another. The customer takes the customer identity part back, in order to reuse it the next time, and the product or service identity part is retained and collected at the place of sale. According to an advantageous alternative, the two parts of the token are separated inside the reading device, and only the consumer identity part is ejected in order to be given back to the customer.

When the customer wants to use the token next time, he takes the token of the next product or service and disassembles it in order to get the corresponding product or service identity part. Then, he assembles his customer identity part with that new product or service identity part, in order to form a new complete token. This new token will then be read and dealt with as previously described herein.

DETAILED DESCRIPTION OF PREFERRED EMBODIMENTS

Figure 1:
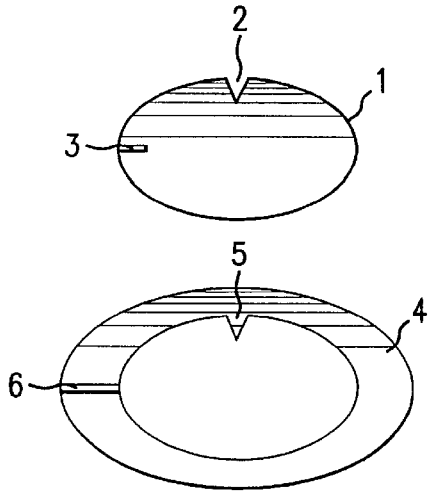
FIG. 1 is a perspective view of a first embodiment of a two-part token of the present invention, with its parts being disassembled.

The token shown in FIG. 1 is composed of an inner part 1 and an outer part 4. The inner part 1 is a cardboard disk with an indent 2. A bar code 3 is stamped or printed on inner part 1.

The outer part 4 of the token is ring shaped and is also made of cardboard. Outer part 4 has a projection 5 which fits into indent 1. The diameter of the external edge of disk 1 is almost exactly the same as the inner diameter of ring 4 so that, when disk 1 is placed in ring 4, it is retained, in spite of its weight, by the forces of friction exercised between the outer lateral face of disk 1 and the inner edge of ring 4. However, disk 1 can be detached from ring 4 by simply pressing it with one finger.

Figure 2:
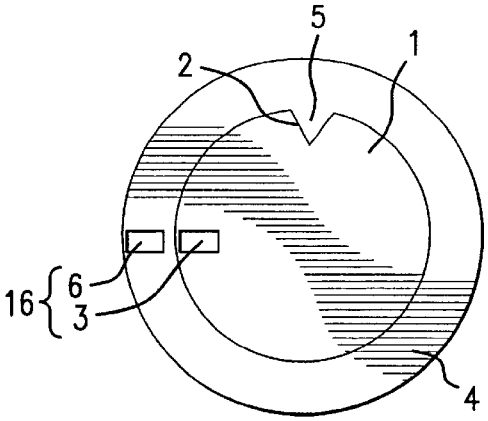
FIG. 2 is a schematic diagram of the assembled two-part token from FIG. 1.

Ring 4 further has a bar code 6 stamped or printed thereon. When the two parts 1 and 4 are assembled and indent 2 and projection 5 are fitted together, bar code 6 becomes the extension of bar code 3 and vice versa. When both codes are situated adjacent to one another, as shown in FIG. 2, then they can be read as a unique code 16. Or, at least, they can be read by a single reading device in a unique reading step.

Figure 3:
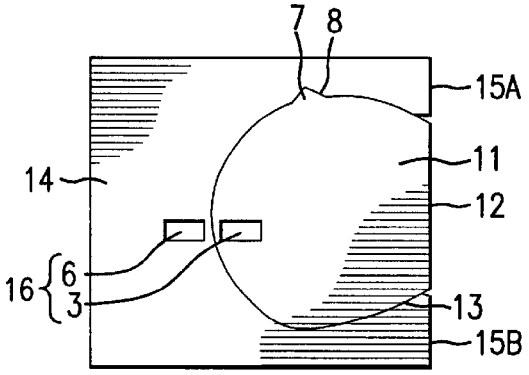
FIG. 3 is a schematic diagram of a second embodiment of a token according to the present invention.

FIG. 3 is a schematic diagram of a second embodiment of a token according to the present invention. This token is composed of an inner part 11 and an outer part 14. This token differs from the one shown in FIGS. 1 and 2 essentially in as far as the outer part 14 does not surround the inner part 11 entirely, but only to a large extent.

The inner part 11 is a cardboard disk of essentially circular shape, on which two sections have been cut off, one along a straight edge 12 and the outer one along a slightly curved edge 13. Disk 11 is further provided with a projection 7 and a bar code 3.

The outer part 14 is externally of rectangular shape and has an internal cut off of mainly circular shape, into which fits the disk 11. The outer part 14 is not ring shaped since one section of the ring has been cut off along edges 15A and 15B. When the two part-token is assembled, the edges 15A and 15B and the edge 12 are in line.

The inner part 11 is further provided with a projection 7, whereas the outer part 14 is provided with a corresponding indent 8. The outer part 14 is further provided with a bar code 6 stamped or printed thereon. Bar codes 3 and 6 are disposed in the same manner as in the embodiment of FIG. 2 and, therefore, they can be read as unique code 16 as described before.

The embodiment shown on FIG. 3 comprises several additional features that any token according to the present invention can be provided with, independently from the rectangular shape of the outer part 14.

First of all, the token of FIG. 3 differs from the one of FIG. 2 in as much as the projection and the indent are in an inverse position. However, whether the indent is located on the inner part or on the outer part and, correspondingly, whether the projection is located on the outer part or on the inner part, in either case, the inner part has to be inserted into the outer part such that the projection is fixed into the indent, in order to be sure that both bar codes 3 and 6 are in line with one another.

Second, the embodiment of FIG. 3 comprises an additional feature that allows to be sure that the inner part is correctly fitted into the outer part: a slanted edge 13. Since the edge 13 is in an asymmetric position with respect to the projection 7, the inner part 11 cannot be inserted into the outer part 14 in such a way that the front side of one part would be adjacent to the rear side of the other part. This feature can also be applied to the first embodiment represented in FIGS. 1 and 2. This feature is particularly useful when both sides of the token are covered with illustrations, advertisements or the like: then, certain persons might have some difficulties to detect the codes and to insert the inner part in the correct manner into the outer part, when bar codes 3 and 6 are printed on one side, only.

Figure 4:
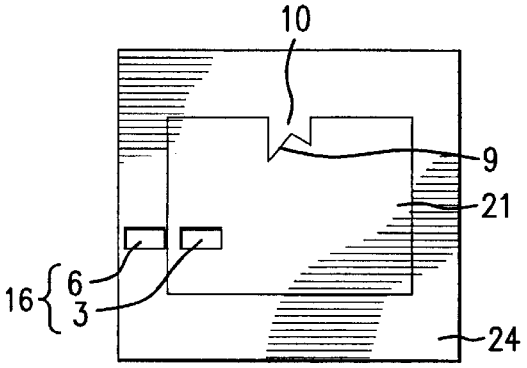
FIG. 4 is a schematic diagram of a third embodiment of a token according to the present invention.

FIG. 4 shows a third embodiment of the token of the present invention. This token comprises an inner part 21 and an outer part 24. Both, the inner part and the outer part are rectangular, and the outer part 24 surrounds the inner part 21 entirely. Further, the inner part 21 and the outer part 24 are each provided with the bar code. The bar codes 3 and 6 can be read as a unique code 16 as explained before.

The inner part 21 is provided with an indent 9 and the outer part 24 is provided with the corresponding projection 10. Indent 9 and projection 10 could of course be situated in an inverse position corresponding to the situation of the token of FIG. 3.

As far as the shapes of indent 9 and projection 10 are concerned, they differ from the ones from FIGS. 2 and 3 insofar as indent 9 and the corresponding projection 10, are not symmetric, but provided with a more complex shape. Indent 9 is represented as essentially W-shaped, having two angular sections of different size. Due to this asymmetric form, front side and rear side of the inner part 21 cannot be inverted when inserting the inner part 21 into the outer part 24. Thereby, once again, care has been taken to avoid an undue positioning of bar codes 3 and 6 when the token is being assembled.

Figure 5:
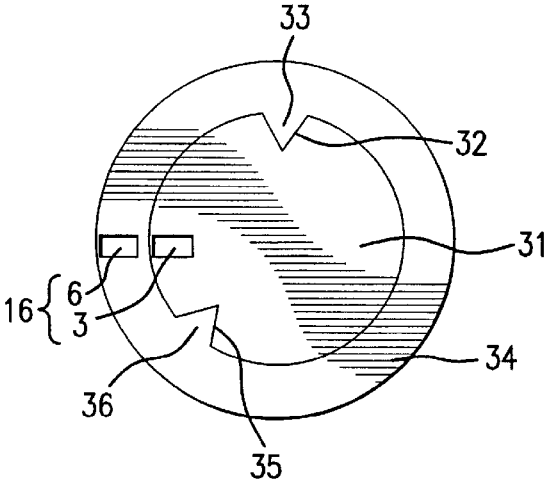
FIG. 5 is a schematic diagram of a fourth embodiment of a token according to the present invention.

According to a fourth embodiment shown on FIG. 5, the token comprises an inner part 31 and an outer part 34. The inner part 31 is provided with a bar code 3 and the outer part 34 is provided with a bar code 6. Bar codes 3 and 6 can be read as a unique code 16 as explained further up together with the token of FIGS. 1 and 2.

The inner part 31 is provided with two indents 32, 35, whereas the outer part 34 is provided with two corresponding projections 33, 36. The indents 32 and 35 and, correspondingly, the projections 33 and 36 are not disposed on the diameter of disk 31 or outer part 34, but in an asymmetric position. Thereby, the pair of projections and the pair of indents provide the same security to the token of FIG. 5 as the complex index of the token of FIG. 4 and the slanted edge of the token of FIG. 3: to avoid an improper assembly of the inner part into the outer part.

Figure 6:
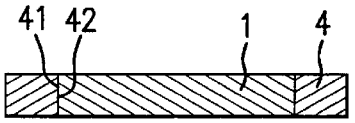
FIG. 6 is a sectional view of a token according to the present invention.
Figure 7:
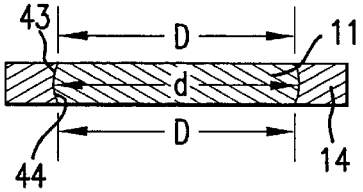
FIG. 7 is a sectional view of another token according to the present invention.

FIGS. 6 and 7 are two sectional views of any two tokens of the ones described up to here. The references 1 and 11 for the inner part and respectively 4 and 14 for the outer part are not to be understood as a limitation to the first and second embodiment of the token of the present invention.

FIG. 6 thus shows the case of the token of the present invention with an outer part, the opening of which has been obtained by a punch. Therefore, the outer part 4 has a straight edge 41. Accordingly, the inner part 1 has a straight outer edge 42. This configuration can advantageously be used for tokens which are entirely made of cardboard.

FIG. 7 shows the case where at least the outer part 14 is made of plastic material. In this case, the outer part comprises a curved inner edge 43 obtained by moulding. Edge 43 is formed such that it has an inner diameter d which is slightly larger than an outer diameter D at the upper and lower face of outer part 14. Accordingly, inner part 11 has an outer edge 44 with a convex shape fitting into the concave shape of edge 43.

What is claimed is:

1. A two-piece token comprising:

A first piece having at least one of an indent and a projection at a periphery thereof, and a first user code on a first side thereof; and a second piece having an inner edge at least partially surrounding the periphery of said first piece, and at least one of a complementary projection and an indent on said inner edge that engages with the at least one of the indent and projection of said first piece, said second piece having a second user code on a first side thereof;

wherein said first and second user codes align, forming a unitary user code for scanning by a reader device when said first and second pieces are assembled together.

2. The two-piece token as claimed in claim 1, wherein the at least one complementary indent and projection of said first and second pieces are one of a V-shape and a W-shape.

3. The two-piece token as claimed in claim 1, wherein the inner edge of said second piece fully surrounds an outer edge of said first piece.

4. The two-piece token as claimed in claim 3, wherein said first piece is disk-shaped and said second piece is annular.

5. The two-piece token as claimed in claim 4, further comprising two of each said complementary indents and projections on each of said first and second pieces, said two complementary indents and projections being at different radii of said second piece.

6. The two-piece token as claimed in claim 3, wherein said first and second pieces are substantially rectangular.

7. The two-piece token as claimed in claim 1, wherein an outer edge of said first piece is convex and said inner edge of said second piece is concave, said outer edge of said first piece fitting into said inner edge of said second piece in a snap-fit manner.

8. The two-piece token as claimed in claim 1, wherein said first and second pieces are releasably attached by frictional forces and wherein said first and second user codes are bar codes that are adjacent to each other.

9. The two-piece token as claimed in claim 1, wherein a first outer part of an outer edge of said first piece is straight and a second outer part of said outer edge of said first piece is slanted, and wherein first and second parts of an outer edge of said second piece are straight and a first inner part of said inner edge of said second piece is complementarily slanted to said slanted part of the first piece, when said first and second pieces are assembled together, said first outer part of said first piece aligns with said first and second parts of said second piece, and said second outer part of said first piece fits into said first inner part of said second piece to prevent misalignment of said first and second bar codes.

10. A method of using a two-piece token comprising the steps of:

inserting a first piece of the two-piece token having at least one of an indent and a projection at a periphery thereof and a first user code on a first side thereof, into a second piece of the two piece token, the second piece having an inner edge at least partially surrounding the periphery of the first piece, the inner edge having at least one of a complementary indent and projection and a second user code on a first side thereof, the first and second pieces being held together by friction;

simultaneously reading the first and second user codes of the two-piece token using a reader device to ascertain whether one of the first and second user codes is in a memory of the code reader and to determine the occurrence of an event based on information contained in the first and second user codes; and rewarding a user of the two-piece token based on the event matching a predetermined condition.

11. The method of using a two-piece token according to claim 10, wherein said simultaneous reading step further comprises identifying the user based on one of the first and second user codes.

12. The method of using a two-piece token according to claim 10, wherein said simultaneous reading step further comprises identifying a product purchased by the user based on one of the first and second user codes.

13. The method of using a two-piece token according to claim 12, wherein said simultaneous reading step further comprises identifying a seller of the product based on one of the first and second user codes.

14. The method of using a two-piece token according to claim 13, further comprising the step of separating the two-piece token into the first and second pieces.

15. The method of using a two-piece token according to claim 14, wherein the step of separating further comprises separating the two-piece token inside the reader device and ejecting said one of the first and second pieces that contains the identity of the user.

* * * * *